US008202062B2

(12) United States Patent
Inoue et al.

(10) Patent No.: US 8,202,062 B2
(45) Date of Patent: Jun. 19, 2012

(54) COMPRESSOR AND METHOD FOR OPERATING THE SAME

(75) Inventors: Yoshinori Inoue, Kariya (JP); Naoki Koeda, Kariya (JP); Akinobu Kanai, Kariya (JP); Hiroyuki Nakaima, Kariya (JP); Tomoji Tarutani, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 994 days.

(21) Appl. No.: 11/895,087

(22) Filed: Aug. 22, 2007

(65) Prior Publication Data

US 2009/0074592 A1 Mar. 19, 2009

(30) Foreign Application Priority Data

Aug. 25, 2006 (JP) ..... P2006-228861

(51) Int. Cl.
*F04B 39/04* (2006.01)

(52) U.S. Cl. ..... 417/228; 417/372; 417/521

(58) Field of Classification Search ..... 417/228, 417/372, 521, 222.2, 269; 92/79, 154
See application file for complete search history.

(56) References Cited

U.S. PATENT DOCUMENTS

| | | | | |
|---|---|---|---|---|
| 4,019,342 | A * | 4/1977 | Ohta | 62/469 |
| 4,669,272 | A * | 6/1987 | Kawai et al. | 62/228.3 |
| 4,856,292 | A * | 8/1989 | Kawai et al. | 62/217 |
| 5,088,897 | A * | 2/1992 | Kawai et al. | 417/269 |
| 5,580,224 | A * | 12/1996 | Ikeda et al. | 417/269 |
| 5,718,566 | A | 2/1998 | Ikeda et al. | 417/269 |
| 5,823,294 | A * | 10/1998 | Mizutani et al. | 184/6.3 |
| 6,010,314 | A * | 1/2000 | Kobayashi et al. | 417/222.2 |
| 6,134,898 | A * | 10/2000 | Umemura et al. | 62/193 |
| 6,174,140 | B1 | 1/2001 | Ota et al. | |
| 6,217,293 | B1 * | 4/2001 | Murase et al. | 417/222.2 |
| 6,568,913 | B1 * | 5/2003 | Strikis et al. | 417/199.1 |
| 2004/0148947 | A1 * | 8/2004 | Ota et al. | 62/84 |
| 2004/0221610 | A1 * | 11/2004 | Yamada et al. | 62/470 |
| 2005/0031456 | A1 * | 2/2005 | Hibino et al. | 417/222.2 |
| 2006/0165535 | A1 | 7/2006 | Ota et al. | 417/222.2 |

FOREIGN PATENT DOCUMENTS

CN 1221073 A 6/1999

(Continued)

OTHER PUBLICATIONS

Chinese Office Action issued on Mar. 27, 2009, for the corresponding Chinese Patent Application No. 2007101468485 (English translation provided).

(Continued)

*Primary Examiner* — Charles Freay
*Assistant Examiner* — Patrick Hamo
(74) *Attorney, Agent, or Firm* — Locke Lord LLP

(57) ABSTRACT

A compressor comprises a suction passage; an oil reservoir for storing a lubricating oil which is separated from a refrigerant gas having a discharge pressure; and a throttle valve provided in the suction passage and having a valve body for adjusting an opening degree of the suction passage based on a differential pressure applied to the valve body. The suction passage has an upstream suction passage which is located upstream of the throttle valve. The compressor comprises a lubricating oil passage connecting the oil reservoir to the upstream suction passage for the lubricating oil in the oil reservoir to flow to the upstream suction passage therethrough.

11 Claims, 8 Drawing Sheets

FOREIGN PATENT DOCUMENTS

| | | | |
|---|---|---|---|
| JP | 59-179284 | | 11/1984 |
| JP | 64-073192 | A | 3/1989 |
| JP | 5-195949 | | 8/1993 |
| JP | 6-10835 | | 1/1994 |
| JP | 10-311277 | | 11/1998 |
| JP | 2000-283070 | A | 10/2000 |
| JP | 2001-27177 | | 1/2001 |
| JP | 2003-035286 | A | 2/2003 |
| JP | 2004-084633 | A | 3/2004 |
| JP | 2005-337232 | A | 12/2005 |
| KR | 10-0209480 | | 4/1999 |

OTHER PUBLICATIONS

Japanese Office Action for Application No. 2006-228861, dated Sep. 12, 2011.

* cited by examiner

COMPRESSOR AND METHOD FOR OPERATING THE SAME

BACKGROUND OF THE INVENTION

The present invention relates to a compressor and a method of operating the same and more particularly to a compressor having a throttle valve which is provided in a suction passage which is in communication with a suction chamber and a method of operating the same.

Unexamined Japanese Patent Application Publication No. 10-311277 discloses a refrigerant compressor, in which a lubricating oil in the form of mist is separated from a refrigerant gas having a discharge pressure to be stored in an oil reservoir before the refrigerant gas is delivered out of the compressor to an external refrigerant circuit. The stored lubricating oil is supplied into a crank chamber.

During the entire operation of the compressor from a maximum displacement operation providing a maximum displacement to a minimum displacement operation providing a minimum displacement, the lubricating oil is constantly supplied from the oil reservoir into the crank chamber. Thus, the lubricating oil can be supplied to the sliding portions of the compressor even during the operation under a high speed and low load condition in which the circulation flow of the refrigerant gas is reduced.

Alternatively, for constantly supplying the lubricating oil to the sliding portions, the separated lubricating oil may be supplied into the crank chamber through the suction chamber.

In the compressor of Unexamined Japanese Patent Application Publication No. 10-311277, however, the lubricating oil is constantly supplied into the crank chamber even during the minimum displacement operation of the compressor. If the lubricating oil is excessively supplied into the crank chamber, rotary elements of the compressor such as swash plate, and the like agitates the lubricating oil at a high speed, thereby generating frictional heat.

The frictional heat raises the temperature of the compressor, which may reduce the lifetime of the sliding portions of the compressor and sealing members made of rubber or resin.

Furthermore, after the operation of the compressor is stopped, the volume of the lubricating oil stored in the oil reservoir is small. In this case, when the compressor is restarted, all of the lubricating oil in the oil reservoir may flow into the crank chamber or the suction chamber, and the refrigerant gas having the discharge pressure may return from the oil reservoir into the crank chamber or the suction chamber. This phenomenon is referred to as a gas pass phenomenon.

The present invention, which has been made in view of the above problems, is directed to a compressor which appropriately controls the supply of the lubricating oil from the oil reservoir according to the operation of the compressor by using a throttle valve and a method of operating the compressor.

SUMMARY OF THE INVENTION

A first aspect in accordance with the present invention provides a compressor which comprises a suction passage; an oil reservoir for storing a lubricating oil which is separated from a refrigerant gas having a discharge pressure; and a throttle valve provided in the suction passage and having a first valve body for adjusting an opening degree of the suction passage based on a differential pressure applied to the first valve body. The suction passage has an upstream suction passage which is located upstream of the throttle valve. The compressor comprises a lubricating oil passage connecting the oil reservoir to the upstream suction passage for the lubricating oil in the oil reservoir to flow to the upstream suction passage therethrough.

A second aspect in accordance with the present invention provides a method for operating a compressor which separates a lubricating oil from a refrigerant gas having a discharge pressure. The method comprises the steps of: opening or closing a throttle valve which is provided in the suction passage based on a differential pressure applied to a valve body of the throttle valve; flowing the separated lubricating oil to the suction passage upstream of the throttle valve; supplying the lubricating oil to a suction chamber through the throttle valve by opening of the throttle valve; and preventing supply of the lubricating oil to the suction chamber by closing of the throttle valve.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
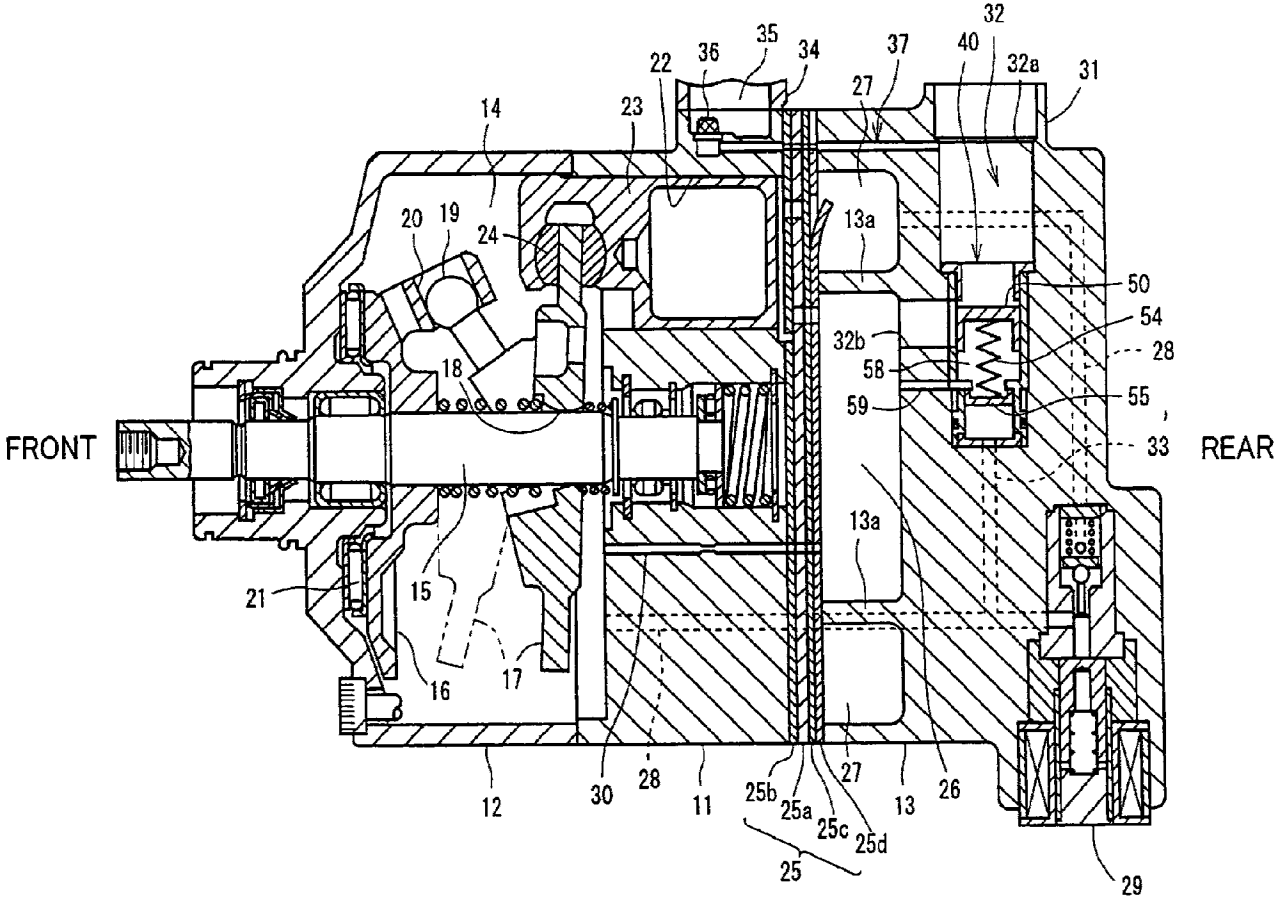
FIG. 1 is a longitudinal cross-sectional view of a clutchless variable displacement compressor of a first preferred embodiment according to the present invention.
Figure 2:
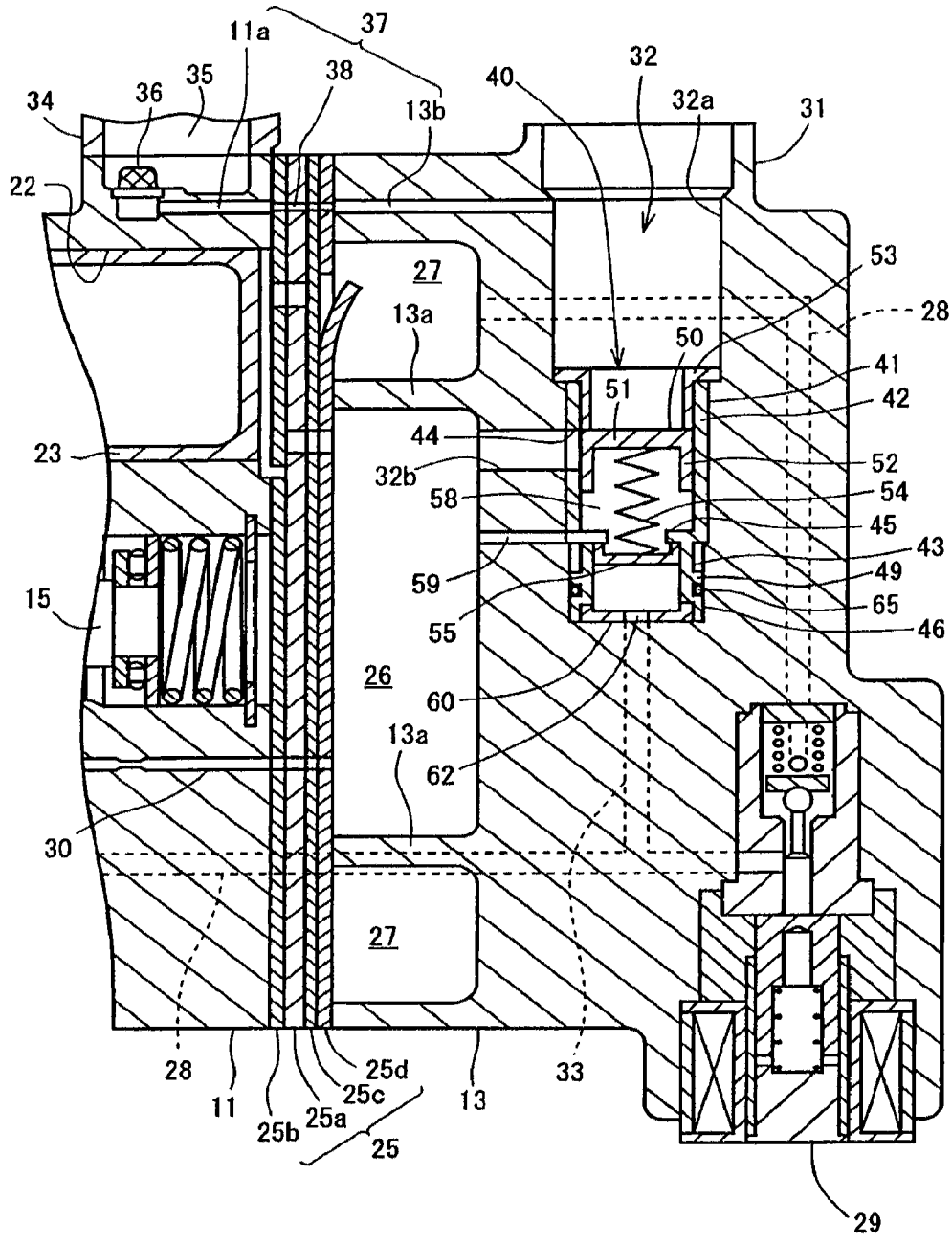
FIG. 2 is a partially enlarged cross-sectional view of the clutchless variable displacement compressor of the first preferred embodiment.
Figure 3:
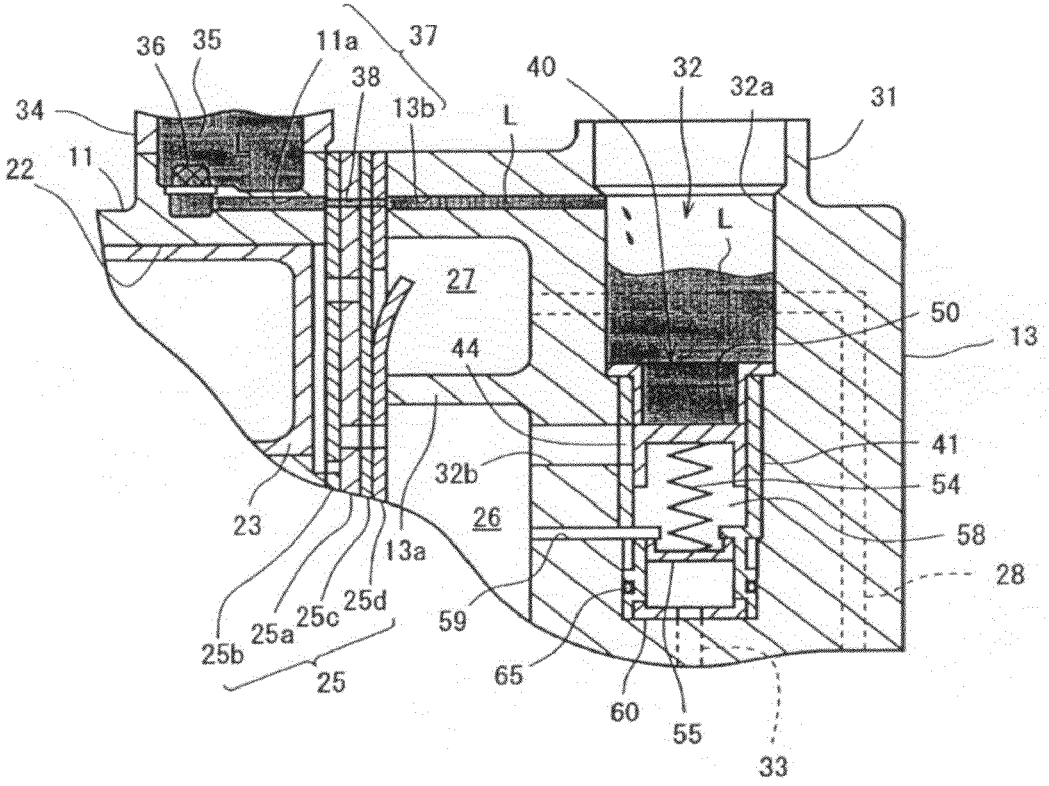
FIG. 3 is a partially enlarged cross-sectional view of the clutchless variable displacement compressor of the first preferred embodiment showing the operation of a throttle valve and the flow of a lubricating oil when a displacement control valve is opened.
Figure 4:
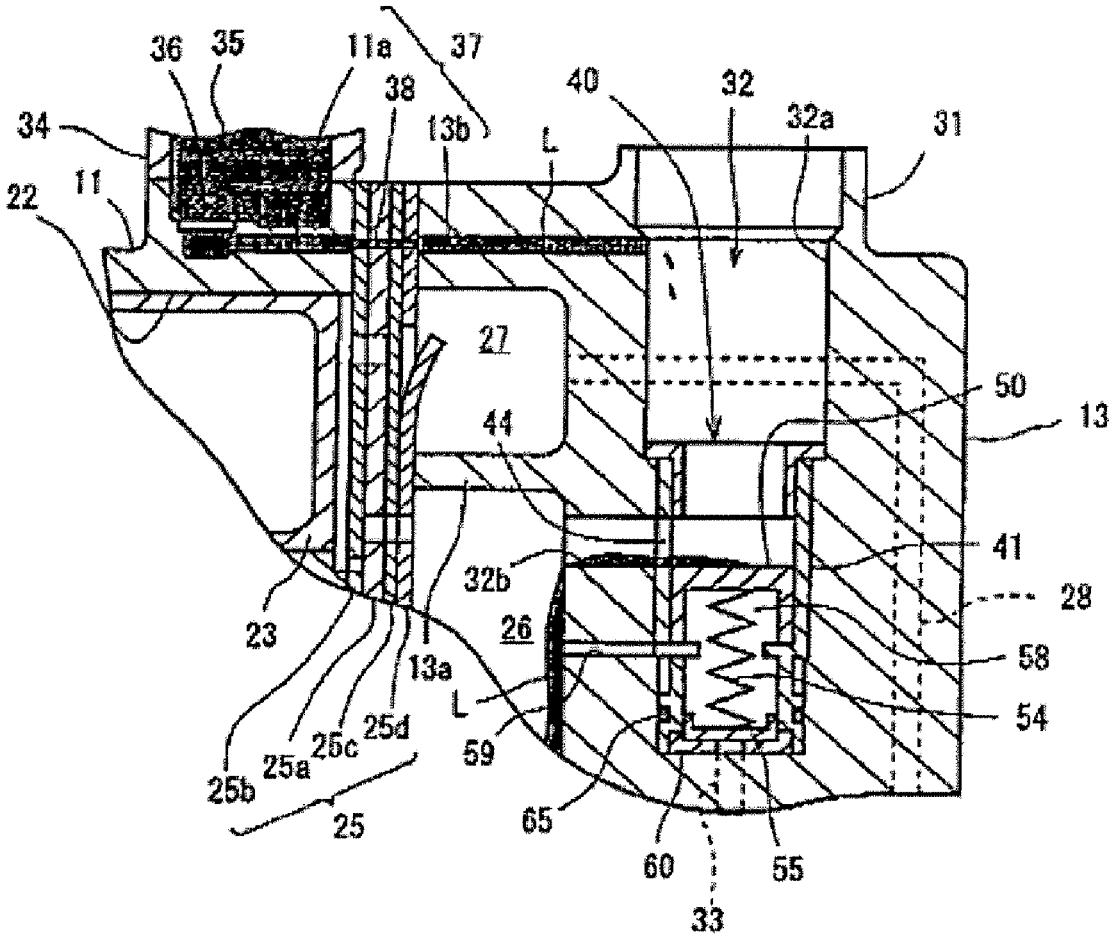
FIG. 4 is a partially enlarged cross-sectional view of the clutchless variable displacement compressor of the first preferred embodiment showing the operation of the throttle valve and the flow of the lubricating oil when the displacement control valve is closed.

The following will describe a variable displacement compressor of a first preferred embodiment according to the present invention with reference to FIGS. 1 through 4. FIG. 1 is a longitudinal cross-sectional view of the variable displacement compressor of the first preferred embodiment according to the present invention, FIG. 2 is a partially enlarged cross-sectional view of the variable displacement compressor. FIG. 3 is a partially enlarged cross-sectional view of the variable displacement compressor showing the operation of a throttle valve and the flow of a lubricating oil when a displacement control valve is opened, and FIG. 4 is a partially enlarged cross-sectional view of the variable displacement compressor showing the operation of the throttle valve and the flow of the lubricating oil when the displacement control valve is closed. In FIG. 1, the left and right sides of the compressor on the drawing correspond to the front and rear sides, respectively.

Referring to FIG. 1, the compressor has a cylinder block 11, a front housing 12 joined to the front end of the cylinder block 11, and a rear housing 13 joined to the rear end of the cylinder block 11 through a valve forming assembly 25. The cylinder block 11 and the front housing 12 cooperate to define therebetween a crank chamber 14.

A rotary shaft 15 which extends through the crank chamber 14 is rotatably supported by the cylinder block 11 and the front housing 12. The front end of the rotary shaft 15 extends out of the front housing 12 and is connected to a mechanism (not shown) which receives power from an engine or a motor of vehicle (not shown). In this embodiment, the compressor is a clutchless type in which the power of the engine or the motor is constantly transmitted to the rotary shaft 15.

In the crank chamber 14, a lug plate 16 is secured on the rotary shaft 15, and a swash plate 17 is provided on the rotary shaft 15. The swash plate 17 has at the center thereof a hole 18 through which the rotary shaft 15 is inserted. The swash plate 17 has guide pins 19 which are slidably inserted in guide holes 20 formed in the lug plate 16 so that the swash plate 17 is connected to the lug plate 16 for rotation with the rotary shaft 15. Sliding motion of the guide pins 19 in the guide holes 20 allows the swash plate 17 to slide in the axial direction of the rotary shaft 15 and to be inclined relative to the rotary shaft 15. A thrust bearing 21 is provided between the lug plate 16 and the front inner wall of the front housing 12, thus the lug plate 16 being rotatable relative to the front housing 12 through the thrust bearing 21.

The cylinder block 11 has formed therein a plurality of cylinder bores 22 (only one cylinder bore being shown in FIG. 1) which are arranged around the rotary shaft 15. Each cylinder bore 22 receives therein a single-headed piston 23 for reciprocation. Though not shown specifically in the drawing, the sliding surface of the piston 23 is coated with hardwearing material. The piston 23 is engaged at the front thereof with the outer peripheral portion of the swash plate 17 through a pair of shoes 24. As the swash plate 17 is driven to rotate by the rotary shaft 15, each piston 23 is moved reciprocally in its associated cylinder bore 22 by way of the shoes 24.

A flange 34 is joined to the upper portion of the outer periphery of the cylinder block 11, and the flange 34 and the cylinder block 11 cooperate to define an oil reservoir 35 for storing a lubricating oil therein. The lubricating oil in the form of mist contained in a refrigerant gas having a discharge pressure is separated by an oil separator (not shown) from the refrigerant gas to be stored in the oil reservoir 35. The oil separator is provided in a refrigerant gas passage (not shown) which connects a discharge chamber 27, which will be described later, to an external refrigerant circuit (not shown). The oil reservoir 35 is located above a throttle valve 40 which will be described later.

A suction chamber 26 is defined in the center region of the rear housing 13 in facing relation to the valve forming assembly 25. A discharge chamber 27 is defined in the rear housing 13 radially outward of the suction chamber 26. As shown in FIGS. 1 and 2, these chambers 26 and 27 are separated by a partition wall 13*a* formed in the rear housing 13. The communication passage 28 is formed in the cylinder block 11 and the rear housing 13 so as to connect the discharge chamber 27 to the crank chamber 14. In the communication passage 28, an electromagnetically-operated displacement control valve 29 is arranged. A bleed passage 30 is formed in the cylinder block 11 so as to connect the crank chamber 14 to the suction chamber 26.

The rear housing 13 has formed therein an inlet 31 and a suction passage 32 which connects the inlet 31 to the suction chamber 26. The inlet 31 is connected to the external refrigerant circuit. A throttle valve 40 is located in the suction passage 32 for adjusting the opening degree of the suction passage 32. The upstream and downstream sides of the suction passage 32 with respect to the throttle valve 40 is referred to as upstream and downstream suction passages 32*a* and 32*b*, respectively.

Referring to FIG. 2, the throttle valve 40 has a cylindrical valve housing 41 which is made of resin. The valve housing 41 has an upper portion 42 which accommodates therein a valve body 50 as a first valve body and a lower portion 43 which accommodates therein a valve body 55 as a second valve body. In this embodiment, in FIGS. 1 through 4, the sides of the upper and lower portions 42 and 43 correspond to the upper and lower sides of the throttle valve 40.

The upper portion 42 has an inner diameter which is greater than that of the lower portion 43. The upper portion 42 has at the side face thereof an opening 44 which is in communication with the downstream suction passage 32*b* which faces the suction chamber 26. The valve housing 41 has an outer diameter which corresponds to the inner diameter of the wall surface of the suction passage 32. The valve body 50 has an outer diameter which corresponds to the inner diameter of the upper portion 42 so that it is movable reciprocally vertically in the upper portion 42. The valve body 50 is guided to its lowest position at a maximum flow rate of the refrigerant gas and to its highest position at a minimum flow rate of the refrigerant gas. The valve body 50 has a valve main body 51 and an annular side wall 52 which closes the opening 44 when the valve body 50 is located at its highest position.

The upper portion 42 has at the upper end thereof an upper opening in which a cylindrical cap 53 is inserted. The cylindrical cap 53 has an outer diameter which corresponds to the inner diameter of the upper portion 42. The cylindrical cap 53 has an upper end in the form of a flange, which is engaged with the upper end of the upper portion 42. The cylindrical cap 53 has a lower end which determines the highest position of the valve body 50. The valve housing 41 has an annular projection 45 which projects inwardly from the inner wall of the valve housing 41 between the upper portion 42 and the lower portion 43. The annular projection 45 determines the lowest position of the valve body 50.

The valve body 55 is movable reciprocally in the lower portion 43 and has an outer diameter which corresponds to the inner diameter of the lower portion 43. The highest position of the valve body 55 is determined by the annular projection 45. A coil spring 54 is disposed in a damper chamber 58 defined between the valve bodies 50 and 55 for urging the valve bodies 50 and 55 in the direction which causes the valve bodies 50 and 55 to be separated from each other.

The valve body 55 is guided to its highest position when the discharge chamber 27 communicates with the crank chamber 14 through the communication passage 28, or when the displacement control valve 29 is opened. When moved to its highest position, the valve body 55 moves the valve body 50 to its highest position.

As the valve body 55 is moved to its highest position, the coil spring 54 increase its upward urging force applied to the valve body 50. It is noted that the damper chamber 58 is in communication with the suction chamber 26 through a communication passage 59 as shown in FIGS. 1 and 2.

The lower portion 43 has a lower end 46 which has a diameter greater than that of the large-diameter valve body 55. The lower end 46 holds a valve seat 60. The valve seat 60 has at its center a hole 62 which is connected to a branch passage 33 which is branched from the communication passage 28 in the rear housing 13. The upper surface of the valve seat 60 determines the lowest position of the valve body 55.

The lower portion 43 has a rib 49 above the lower end 46. O-ring 65 is interposed between the rib 49 and the lower end 46. O-ring 65 serves to prevent the refrigerant gas having a pressure in the crank chamber 14 (or a crank pressure Pc) from leaking to the suction side. The valve body 55 is moved reciprocally in the lower portion 43 while receiving the crank pressure Pc from the branch passage 33.

A lubricating oil passage 37 is provided between the upstream suction passage 32*a* and the oil reservoir 35 and has a hole 11*a* formed in the cylinder block 11 so as to be in communication with the oil reservoir 35, a hole 13*b* formed in the rear housing 13 so as to be in communication with the upstream suction passage 32*a*, and a throttled hole 38 formed in the valve forming assembly 25. The lubricating oil passage 37 supplies the lubricating oil in the oil reservoir 35 to the upstream suction passage 32*a*. A filter 36 is provided at the opening of the hole 11*a* in the oil reservoir 35 for separating foreign substances present in the lubricating oil before the lubricating oil enters the lubricating oil passage 37. In the preferred embodiment, the valve forming assembly 25 is comprised of a valve plate 25*a*, a suction valve forming plate 25*b*, a discharge valve forming plate 25*c*, and a retainer forming plate 25*d*.

In the preferred embodiment, the throttled hole 38 of the valve forming assembly 25 has an inner diameter which is smaller than those of the holes 11*a* and 13*b* for throttling the lubricating oil to be supplied into the upstream suction passage 32*a*. In other words, the throttled hole 38 provides throttle function in the lubricating oil passage 37. In addition, the throttled holes 38 serves to prevent the refrigerant gas having a discharge pressure from flowing from the oil reservoir 35 through the lubricating oil passage 37 into the upstream suction passage 32*a* when no lubricating oil is stored in the oil reservoir 35. Alternatively, however, the lubricating oil passage 37 having the throttled hole 38 may be changed to a lubricating oil passage having a uniform inner diameter.

The following will describe the operation of the compressor of the preferred embodiment according to the present invention. As the piston 23 reciprocates with the rotation of the rotary shaft 15, the refrigerant gas in the suction chamber 26 is drawn into the cylinder bore 22 through the suction port of the valve forming assembly 25 while opening the suction valve, and the refrigerant gas is compressed and discharged into the discharge chamber 27 while opening the discharge valve. The high-pressure refrigerant gas which has been discharged into the discharge chamber 27 is mainly delivered out of the compressor to the external refrigerant circuit.

The opening degree of the displacement control valve 29 is adjusted to control the balance between the amount of the refrigerant gas which is supplied from the discharge chamber 27 to the crank chamber 14 through the communication passage 28 and the amount of the refrigerant gas which is drawn from the crank chamber 14 to the suction chamber 26 through the bleed passage 30. By controlling the above balance, the crank pressure Pc is determined. As the opening degree of the displacement control valve 29 is adjusted to change the crank pressure Pc, the differential pressure between the crank chamber 14 and the cylinder bore 22 across the piston 23 varies thereby to change the inclination angle of the swash plate 17. Thus, the stroke length of the piston 23 and hence the displacement of the refrigerant compressor is changed.

A fall in the crank pressure Pc increases the inclination angle of the swash plate 17 with respect to the plane perpendicular to the axis of the rotary shaft 15 to increase the stroke length of the piston 23, thus the displacement of the compressor being increased, accordingly. On the other hand, a rise in the crank pressure Pc decreases the inclination angle of the swash plate 17 to decrease the stroke length of the piston 23, thus the displacement of the compressor being decreased.

During the operation of the compressor, the refrigerant gas which flows out of the discharge chamber 27 contains the lubricating oil in the form of mist. The oil separator of the compressor separates the lubricating oil from the refrigerant gas having a discharge pressure. The separated lubricating oil is introduced from the oil separator into the oil reservoir 35 and stored therein as shown in FIGS. 3 and 4. The lubricating oil is designated at the reference symbol L in FIGS. 3 and 4. The lubricating oil L in the oil reservoir 35 is introduced into the upstream suction passage 32*a* through the lubricating oil passage 37.

The displacement of the compressor depends on the inclination angle of the swash plate 17 according to the opening degree of the displacement control valve 29. The throttle valve 40 is operated so as to follow the opening and closing operation of the displacement control valve 29. As the displacement control valve 29 is changed from the closed state to the open state, the inclination angle of the swash plate 17 is gradually decreased to be minimum thereby to provide a minimum displacement operation (OFF operation) of the compressor. Following this process, the throttle valve 40 is operated so that the valve body 55 moves upward toward its highest position to urge the valve body 50 through the coil spring 54 in the direction which causes the valve body 50 to be closed.

The differential pressure between the damper chamber 58 and the suction passage 32 facing the valve body 50 is decreased. Thus, the valve body 50 is moved upward to close the suction passage 32. Since the side wall 52 of the valve body 50 opens and closes the opening 44 according to the flow rate of the drawn refrigerant gas, it serves as a variable throttle between the suction passage 32 and the suction chamber 26. This prevents the self-excited vibration of the suction valve due to pressure variation.

Referring to FIG. 3, when the valve body 50 closes the opening 44, the lubricating oil L which has been introduced into the upstream suction passage 32*a* through the lubricating oil passage 37 is stored in the upstream suction passage 32*a*. Most of the lubricating oil L from the oil reservoir 35 is stored in the upstream suction passage 32*a* upstream of the valve body 50, and no lubricating oil L is introduced into the suction chamber 26. Thus, the lubricating oil L is not excessively stored in the crank chamber 14.

When the displacement control valve 29 is changed from the open state to the closed state, the inclination angle of the swash plate 17 is gradually increased to be maximum thereby to provide a maximum displacement operation of the compressor. In this process, the valve body 55 is moved downward from its highest position toward its lowest position, and no urging force of the coil spring 54 is applied to the valve body 50. When the valve body 50 closes the suction passage 32 during the maximum displacement operation of the compressor, the refrigerant gas is maximumly drawn from the suction chamber 26 into the cylinder bore 22, thereby increasing the difference pressure between the damper chamber 58 and the suction passage 32 facing the valve body 50. Thus, the valve body 50 is moved downward to open the suction passage 32.

When the valve body 50 opens the opening 44, most of the lubricating oil L in the upstream suction passage 32*a* flows through the opening 44 and the downstream suction passage 32*b* into the crank chamber 14.

According to the compressor of the first preferred embodiment described above, the following advantageous effects are obtained.

(1) When the throttle valve 40 opens the suction passage 32, the lubricating oil L in the oil reservoir 35 is introduced into the suction chamber 26 through the lubricating oil passage 37, the upstream suction passage 32*a*, the throttle valve 40, and the downstream suction passage 32*b*. On the other hand, when the throttle valve 40 closes the suction passage 32, the lubricating oil L which is introduced into the upstream suction passage 32*a* through the lubricating oil passage 37 is stored in the upstream suction passage 32*a*. Therefore, when the throttle valve 40 closes the suction passage 32, the separated lubricating oil L is not excessively supplied into the crank chamber 14.

(2) After the operation of the compressor is stopped, the lubricating oil is stored in the upstream suction passage 32*a* upstream of the throttle valve 40. During non-operation of the compressor, the lubricating oil is not excessively stored in the crank chamber 14. In re-starting the compressor, the lubricating oil is prevented from being agitated and compressed by the rotary elements such as the swash plate 17 and the like. This prevents a reduction in the lifetime of the compressor and deterioration of the performance of the compressor due to the rise in temperature of the compressor by the agitation of the lubricating oil.

(3) The separated lubricating oil returns to the suction passage 32 through the lubricating oil passage 37. This promotes the temperature of the lubricating oil to be lowered, thereby improving the lifetime of the compressor.

(4) The lubricating oil is supplied into the upstream suction passage 32*a* upstream of throttle valve 40. Thus, the lubricating oil enters the clearance between the valve body 50 and the inner peripheral surface of the valve housing 41 thereby to provide oil seal in the throttle valve 40. The oil seal reduces leak between the crank chamber 14 and the suction chamber 26. This results in improvement in the controllability and the performance of the throttle valve 40 which is operated according to the differential pressure between the crank pressure Pc and the suction pressure.

(5) In the case of the variable displacement compressor, if the lubricating oil is excessively stored in the crank chamber 14, when the displacement is increased toward the maximum, the lubricating oil provides resistance against the swash plate 17 so that the inclination of the swash plate 17 is delayed in addition to a rise in the temperature of the compressor by shear heating. The first preferred embodiment prevents the lubricating oil from being excessively stored in the crank chamber 14, thereby providing quick inclination of the swash plate 17.

The following will describe a compressor of a second preferred embodiment according to the present invention with reference to FIGS. 5 through 8. The second preferred embodiment differs from the first preferred embodiment in that a valve is provided in the lubricating oil passage. In the second preferred embodiment, common or similar elements or parts are designated by the same reference numerals as those of the first preferred embodiment and, therefore, the description thereof is omitted.

Figure 5:
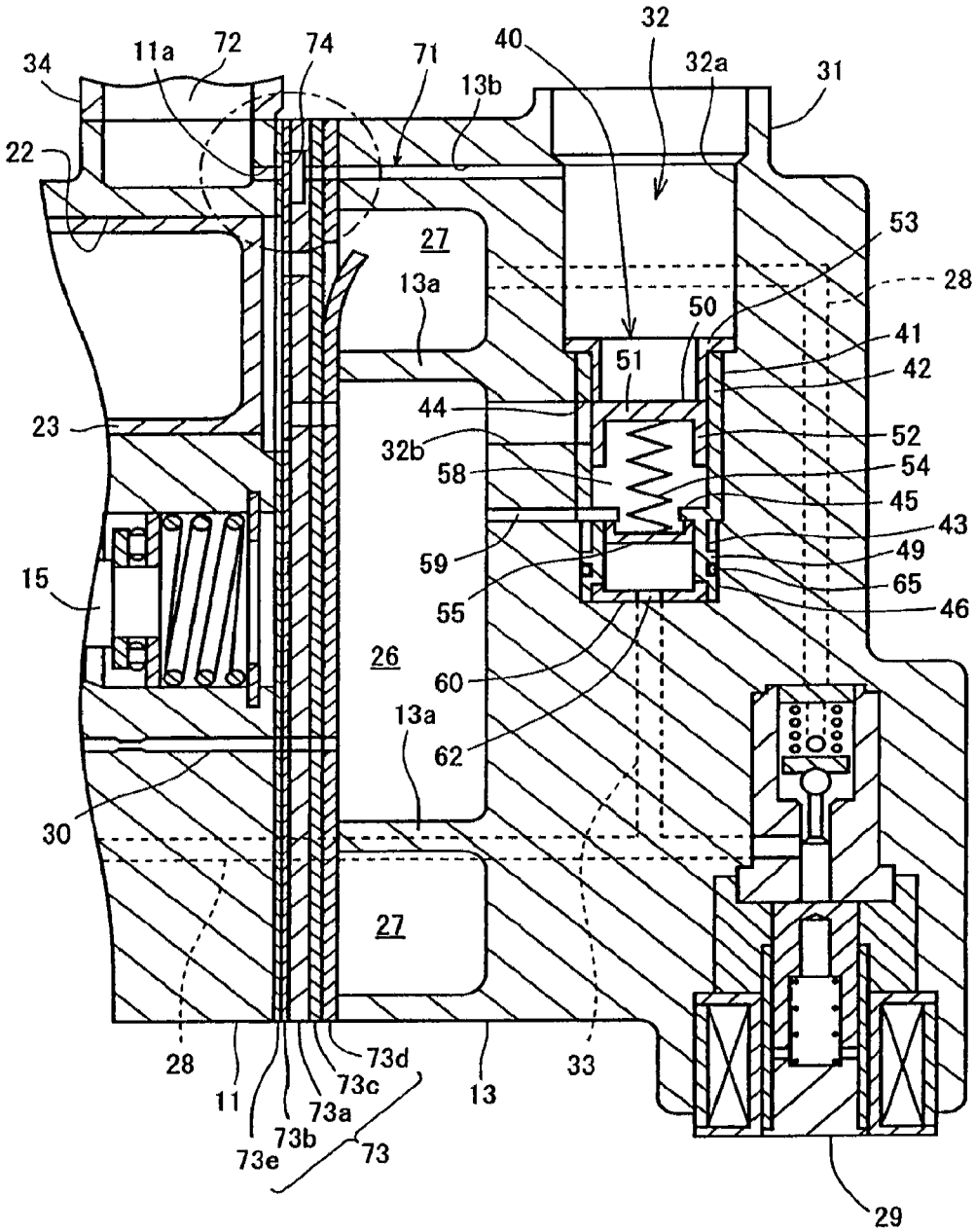
FIG. 5 is a partially enlarged cross-sectional view of a variable displacement compressor of a second preferred embodiment according to the present invention.

Referring to FIG. 5, a lubricating oil passage 71 is provided between the upstream suction passage 32*a* and an oil reservoir 72. The lubricating oil passage 71 has the hole 11*a* formed in the cylinder block 11 so as to be in communication with the oil reservoir 72, the hole 13*b* formed in the rear housing 13 so as to be in communication with the upstream suction passage 32*a*, and holes A, C, D, and E formed in a valve forming assembly 73. In the second preferred embodiment, the compressor dispenses with a filter at the opening of the hole 11*a* in the oil reservoir 72. The valve forming assembly 73 is comprised of a valve plate 73*a*, a suction valve forming plate 73*b*, a discharge valve forming plate 73*c*, a retainer forming plate 73*d*, and a gasket 73*e*. The gasket 73*e* is interposed between the cylinder block 11 and the suction valve forming plate 73*b*.

Figure 6:
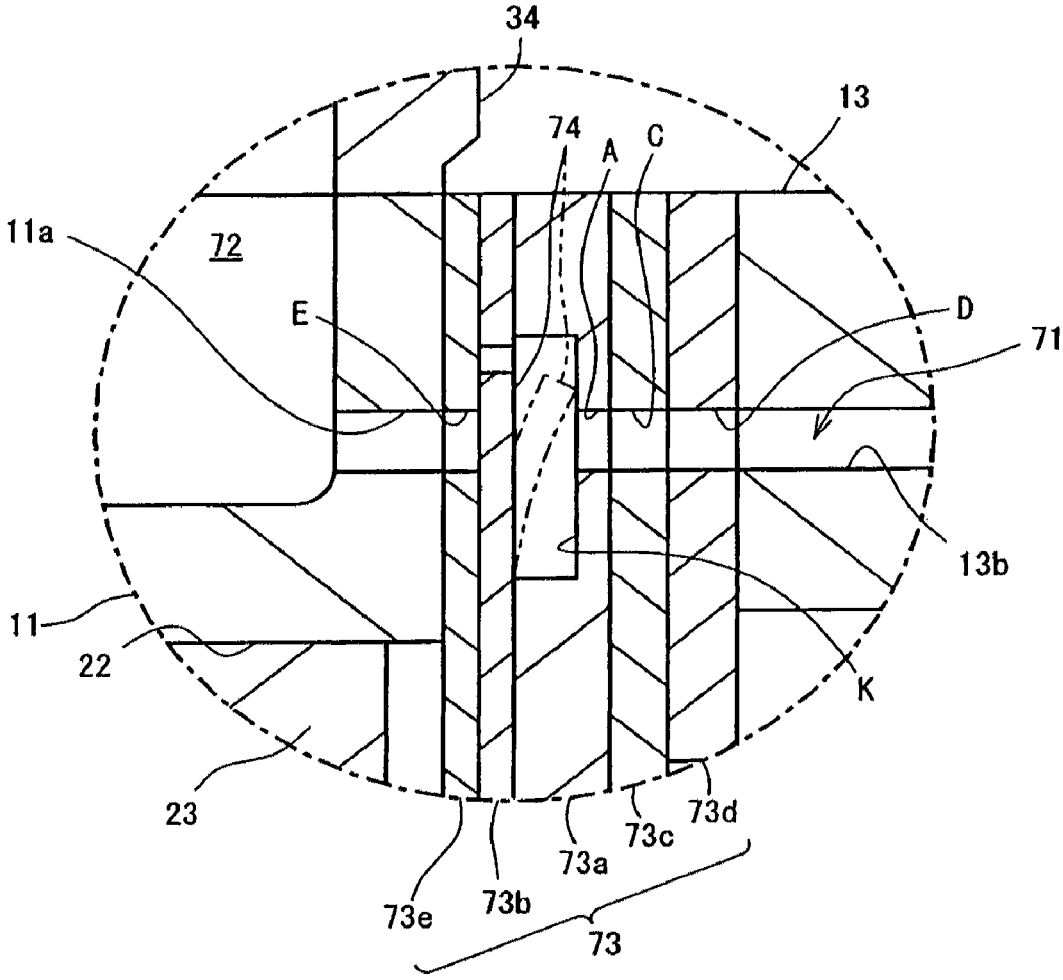
FIG. 6 is a partially enlarged cross-sectional view of the variable displacement compressor of the second preferred embodiment showing a lubricating oil passage.
Figure 7:
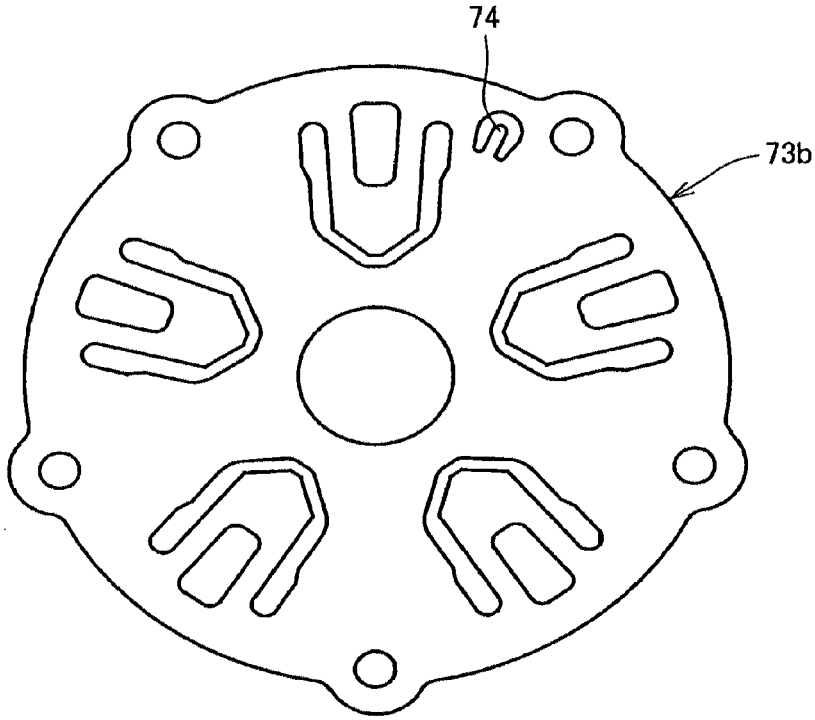
FIG. 7 is a front view of a suction valve forming plate which forms a reed valve of the second preferred embodiment.

Referring to FIG. 6, the holes A, C, D, and E are formed in the valve plate 73*a*, the discharge valve forming plate 73*c*, the retainer forming plate 73*d*, and the gasket 73*e* of the valve forming assembly 73 and have the same diameter as the holes 11*a* and 13*b*. The suction valve forming plate 73*b* has formed therein a reed valve 74 as shown in FIGS. 6 and 7. The reed valve 74 substantially closes the hole E of the gasket 73*e* when not bended as indicated by the solid line in FIG. 6. However, the reed valve 74 is formed so as to allow the lubricating oil to slightly flow from the hole E therethrough in the non-bended state.

The valve plate 73*a* has formed therein a recess K which corresponds to bending of the reed valve 74. When the reed valve 74 is bended to fully open the hole E as indicated by the two-dotted line in FIG. 6, the reed valve 74 substantially closes the hole A. The hole A is formed so as to allow the lubricating oil to slightly pass through the reed valve 74 to the hole A when the reed valve 74 substantially closes the hole A of the valve plate 73*a*. The reed valve 74 is bended by the differential pressure between the pressure in the oil reservoir 72 and the inner pressure in the upstream suction passage 32*a*. In the second preferred embodiment, when not bended, the reed valve 74 substantially closes the hole E of the gasket 73*e*. Thus, the hole E of the gasket 73*e* and the hole A of the valve plate 73*a* correspond to first and second valve holes of the lubricating oil passage 71, respectively.

Figure 8:
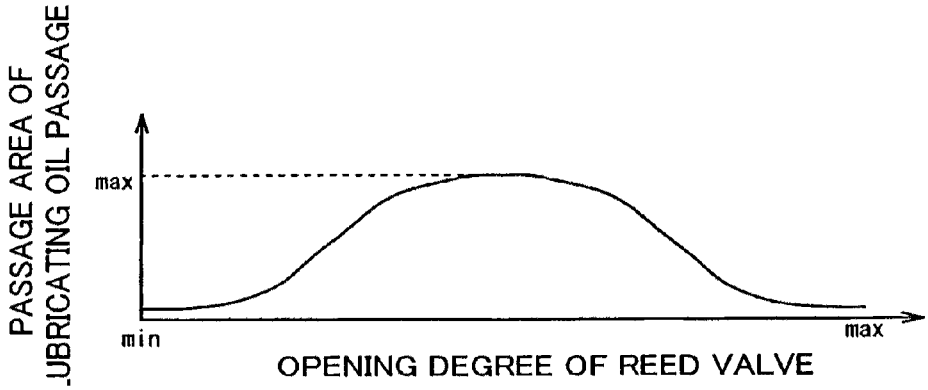
FIG. 8 is a graph showing the relation between the opening degree of the reed valve with respect to a hole E and the passage area of the lubricating oil passage.

In the second preferred embodiment, when the differential pressure between the oil reservoir 72 and the upstream suction passage 32*a* is small, the reed valve 74 is not bended to substantially close the hole E. This reduces the flow rate of the lubricating oil in the lubricating oil passage 71. As the differential pressure between the oil reservoir 72 and the upstream suction passage 32*a* increases, the reed valve 74 is bended to open the hole E, thereby increasing the flow rate of the lubricating oil. However, as the differential pressure increases further, the reed valve 74 is fully bended to substantially close the hole A. This reduces the flow rate of the lubricating oil in the lubricating oil passage 71. FIG. 8 is a graph showing the relation between the opening degree of the reed valve 74 with respect to the hole E and the passage area of the lubricating oil passage 71.

The provision of the reed valve 74 in the lubricating oil passage 71 reliably prevents the refrigerant gas having a discharge pressure from flowing from the oil reservoir 72 into the suction passage 32 through the lubricating oil passage 71 (gas pass phenomenon) when no lubricating oil is stored in the oil reservoir 72 as compared to the case of using a throttled passage. In a high load and low speed operation of the compressor, in spite of the fact that the lubricating oil separation capability is low due to the low flow rate of the refrigerant gas, the discharge pressure could be high due to the high load, and the differential pressure between the oil reservoir 72 and the upstream suction passage 32*a* could be great, so that the flow rate of the lubricating oil in the lubricating oil passage 71 could become large. In this event, the reed valve 74 substantially closes the hole A thereby to reduce the flow rate of the lubricating oil, with the result of that the gas pass phenomenon is prevented. Furthermore, since the reed valve 74 controls and throttles the flow rate of the lubricating oil, there is no need to provide the lubricating oil passage 71 with a throttled passage having a small diameter which may cause clogging of foreign substance. Thus, a filter is not needed.

Figure 9:
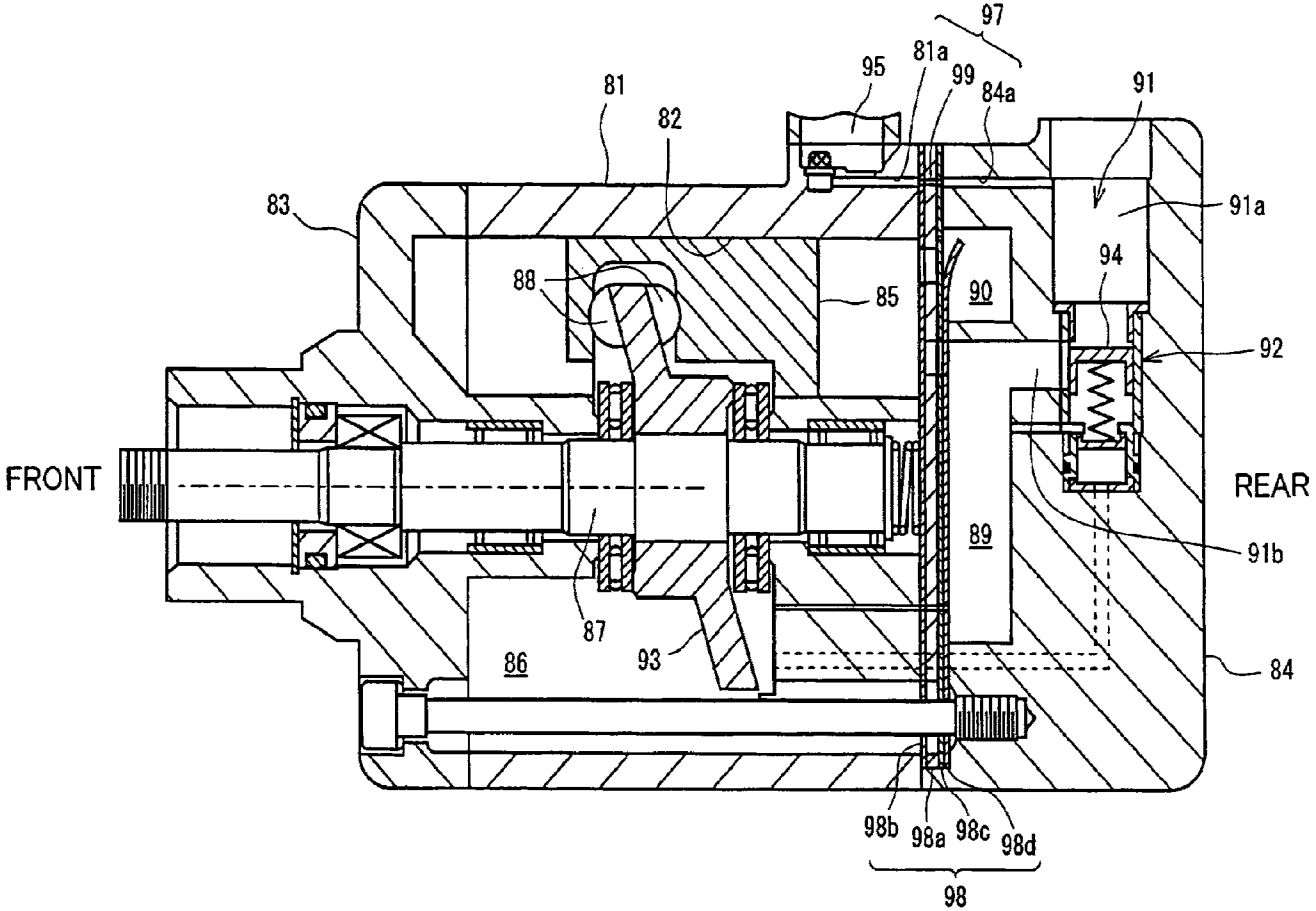
FIG. 9 is a longitudinal cross-sectional view of a fixed displacement compressor of a third preferred embodiment according to the present invention.

The following will describe a compressor of a third preferred embodiment according to the present invention with reference to FIG. 9. The compressor of the third preferred embodiment is a fixed displacement compressor. Referring to FIG. 9, the compressor has a cylinder block 81 having formed therein a plurality of cylinder bores 82, a front housing 83 joined to the front end of the cylinder block 81, and a rear housing 84 joined to the rear end of the cylinder block 81 through a valve forming assembly 98. The valve forming assembly 98 is comprised of a valve plate 98*a*, a suction valve forming plate 98*b*, a discharge valve forming plate 98*c*, and a retainer forming plate 98*d*.

A rotary shaft 87 is rotatably supported by the cylinder block 81 at its center. Each cylinder bore 82 receives therein a single-headed piston 85 for reciprocation. In the cylinder block 81, a crank chamber 86 is defined in which a swash plate 93 is disposed for rotation with a rotary shaft 87. The piston 85 is engaged with the swash plate 93 through a pair of shoes 88, and the swash plate 93 slides relative to the shoes 88.

A suction chamber 89 is defined in the center region of the rear housing 84. A discharge chamber 90 is defined in the rear housing 84 radially outward of the suction chamber 89. In the third preferred embodiment, the rear housing 84 has formed therein a suction passage 91 which is in communication with the suction chamber 89. A throttle valve 92 is arranged in the suction passage 91. The throttle valve 92 has a valve body 94 as a first valve body which is opened and closed according to the differential pressure between the upstream suction passage 91*a* of the suction passage 91 upstream of the throttle valve 92 and the suction chamber 89. The downstream suction passage 91*b* of the suction passage 91 downstream of the throttle valve 92 is in communication with the suction chamber 89. An oil reservoir 95 is provided at the outer periphery of the cylinder block 81 for storing therein the lubricating oil which is separated from the refrigerant gas having a discharge pressure by an oil separator (not shown).

A lubricating oil passage 97 is provided which connects the oil reservoir 95 to the upstream suction passage 91*a*. The lubricating oil passage 97 has a holes 81*a* formed in the cylinder block 81 so as to be in communication with the oil reservoir 35, a hole 84*a* formed in the rear housing 84 so as to be in communication with the upstream suction passage 91*a*, and a throttled hole 99 formed in the valve forming assembly 98. The lubricating oil passage 97 supplies the lubricating oil in the oil reservoir 95 to the upstream suction passage 91*a*. In the third preferred embodiment, the valve forming assembly 98 is comprised of a valve plate 98*a*, a suction valve forming plate 98*b*, a discharge valve forming plate 98*c*, and a retainer forming plate 98*d*. The throttled hole 99 of the valve forming assembly 98 has a diameter which is smaller than those of the holes 81*a* and 84*a*.

In the fixed displacement compressor of the third preferred embodiment, the valve body 94 of the throttle valve 92 closes the suction passage 91 to prevent the refrigerant gas from being supplied through the suction passage 91 into the suction chamber 89. The lubricating oil which is supplied into the upstream suction passage 91*a* through the lubricating oil passage 97 is stored in the upstream suction passage 91*a*. In this case, the separated lubricating oil is not excessively supplied into the suction chamber 89 as a low-pressure region and the crank chamber 86.

The present invention is not limited to the first through third preferred embodiments described above and may be practiced in various other ways as exemplified below.

In the first through third preferred embodiments, a throttle valve has valve bodies connected to each other through a coil spring. Alternatively, the valve bodies may be connected to each other through a connecting member in place of the coil spring, and any type of a throttle valve may be used as long as it has a valve body which is moveable according to the differential pressure between the pressure in the crank chamber and the suction pressure.

In the first through third preferred embodiments, the throttle valve adjusts its opening degree based on the differential pressure between the pressure in the crank chamber and the suction pressure. Alternatively, a throttle valve may be used which opens and closes the suction passage based on the differential pressure between the upstream suction passage and the suction chamber.

In the second preferred embodiment, when the reed valve 74 closes the holes E of the gasket 73*e* as a first valve hole, the lubricating oil slightly flows from the hole E through the reed valve 74. Alternatively, the reed valve 74 may completely prevent the flow of the lubricating oil therethrough when closing the hole E. In the second preferred embodiment, the reed valve 74 is formed in the suction valve forming plate 73*b*. Alternatively, a reed valve may be formed in the discharge valve forming plate 73*c*. The recess K formed in the valve plate 73*a* has substantially a U-shaped cross section. The cross section of the recess may be optionally shaped according to the setting of the opening degree of the reed valve 74.

Therefore, the present examples and embodiments are to be considered as illustrative and not restrictive, and the invention is not to be limited to the details given herein but may be modified within the scope of the appended claims.

What is claimed is:

1. A compressor having a housing member with an inlet formed therein, said compressor comprising:

a suction passage connected to the inlet and a suction chamber, the suction passage is formed in the housing member;

an oil reservoir for storing a lubricating oil which is separated from a refrigerant gas having a discharge pressure;

a throttle valve provided in the suction passage and having a first valve body for adjusting an opening degree of the suction passage based on a differential pressure applied to the first valve body, wherein the suction passage has an upstream suction passage which is located upstream of the throttle valve; and a lubricating oil passage connecting the oil reservoir to the upstream suction passage for the lubricating oil in the oil reservoir to flow to the upstream suction passage therethrough, the lubricating oil passage connected to the upstream suction passage at a position between the inlet and the throttle valve, and the lubricating oil passage includes a valve for controlling a flow of the lubricating oil in the lubricating oil passage, wherein supply of the lubricating oil is controlled according to the operation of the compressor.

2. The compressor according to claim, 1 wherein the valve is a reed valve which opens and closes the lubricating oil passage according to a differential pressure between a pressure in the oil reservoir and a pressure in the upstream suction passage.

3. The compressor according to claim 2, wherein the lubricating oil passage includes first and second valve holes which are opened and closed by the reed valve, the reed valve substantially preventing a flow of the lubricating oil in the first valve hole when closing the first valve hole, the reed valve substantially preventing a flow of the lubricating oil in the second valve hole when fully opened with respect to the first valve hole.

4. The compressor according to claim 3, wherein a gasket, a suction valve forming plate, and a valve plate are interposed between a cylinder block and a housing member having a suction chamber, the first valve hole being formed in the gasket, the second valve hole being formed in the valve plate, the reed valve being formed in the suction valve forming plate, the valve plate determining a maximum opening degree of the reed valve.

5. A compressor having a housing member with an inlet formed therein, said compressor comprising:

a suction passage connected to the inlet and a suction chamber, the suction passage is formed in the housing member;

an oil reservoir for storing a lubricating oil which is separated from a refrigerant gas having a discharge pressure;

a throttle valve provided in the suction passage and having a first valve body for adjusting an opening degree of the suction passage based on a differential pressure applied to the first valve body, wherein the suction passage has an upstream suction passage which is located upstream of the throttle valve; and a lubricating oil passage connecting the oil reservoir to the upstream suction passage for the lubricating oil in the oil reservoir to flow to the upstream suction passage therethrough, the lubricating oil passage connected to the upstream suction passage at a position between the inlet and the throttle valve, wherein the lubricating oil passage has a throttled hole, wherein supply of the lubricating oil is controlled according to the operation of the compressor.

6. The compressor according to claim 1, wherein the throttle valve includes a second valve body connected to the first valve body through a member.

7. The compressor according to claim 6, wherein the member is a coil spring disposed in a chamber which is defined between the first and second valve bodies and is in communication with a suction chamber.

8. The compressor according to claim 6, wherein the second valve body receives a pressure in a crank chamber.

9. A method for operating a compressor which has a housing member with an inlet formed therein and separates a lubricating oil from a refrigerant gas having a discharge pressure, comprising the steps of:

opening or closing a throttle valve which is provided in a suction passage formed in the housing member and connected to the inlet based on a differential pressure applied to a valve body;

flowing the separated lubricating oil to the suction passage upstream through a lubricating oil passage having a throttled hole connected to the suction passage upstream of the throttle valve at a position between the inlet and the throttle valve;

supplying the lubricating oil to a suction chamber through the throttle valve by opening of the throttle valve; and preventing supply of the lubricating oil to the suction chamber by closing of the throttle valve.

10. The compressor according to claim 5, wherein the lubricating oil passage and the throttled hole are formed in the housing member.

11. The compressor according to claim 5, wherein the throttled hole is formed in a valve forming assembly which is interposed between a cylinder block and a housing member having a suction chamber.

* * * * *